US008960171B1

(12) United States Patent
Sinden

(10) Patent No.: US 8,960,171 B1
(45) Date of Patent: Feb. 24, 2015

(54) FINNED ENGINE SPACER

(71) Applicant: Travis E. Sinden, Laveen, AZ (US)

(72) Inventor: Travis E. Sinden, Laveen, AZ (US)

( * ) Notice: Subject to any disclaimer, the term of this patent is extended or adjusted under 35 U.S.C. 154(b) by 0 days.

(21) Appl. No.: 13/948,983

(22) Filed: Jul. 23, 2013

(51) Int. Cl.
*F02M 29/00* (2006.01)
*F02M 19/00* (2006.01)

(52) U.S. Cl.
CPC ..... *F02M 19/00* (2013.01)
USPC ..... 123/590

(58) Field of Classification Search
CPC ..... F02M 35/10032; F02M 35/10196; F02M 35/10262; F02M 35/10268; F02M 35/10085; F02M 23/00
USPC ..... 123/184.23, 184.32, 184.39, 184.46, 123/590, 336; 261/23.3
See application file for complete search history.

(56) References Cited

U.S. PATENT DOCUMENTS 1,697,795 A 1/1929 Summers
2,573,095 A 10/1951 Ellis
3,011,320 A 12/1961 Blogoslawski
3,246,841 A 4/1966 Kling
3,285,588 A 11/1966 Huddle
3,332,476 A 7/1967 McDougal
4,215,663 A * 8/1980 Gaylord ..... 48/189.4
5,353,772 A 10/1994 Wallace et al.

FOREIGN PATENT DOCUMENTS

DE 2709042 A1 * 9/1978 ..... F02M 23/00

* cited by examiner

*Primary Examiner* — Hung Q Nguyen
(74) *Attorney, Agent, or Firm* — Thomas W. Galvani, P.C.; Thomas W. Galvani

(57) ABSTRACT

A finned engine spacer is coupled in thermal communication between an intake manifold and a fluid metering device. The spacer includes a body having an upstream face, an opposed downstream face, and sides extending between the upstream and downstream faces, the sides cooperating to form an outer periphery. A bore is formed through the body from the upstream face through to the downstream face, the bore for communicating a fuel charge from the fluid metering device to the intake manifold. Fins are formed in each of the sides, and the fins extend between the bore and the outer periphery, creating a finned engine spacer.

24 Claims, 6 Drawing Sheets

FINNED ENGINE SPACER

FIELD OF THE INVENTION

The present invention relates generally to engines, and more particularly to carbureted and fuel-injected automobile engines.

BACKGROUND OF THE INVENTION

Before the development of fuel injection systems, automotive engines were carbureted. Carbureted engines depend on a carefully calibrated carburetor to precisely mix a combination of fuel and air to provide an efficient combustion within the engine. The purpose of the carburetor is to deliver a maximum amount of power to the engine while also controlling emissions from the engine within acceptable limits. A number of factors affect the performance of the carburetor, such as the flow of air into the engine, the flow of air through an air filter into the carburetor, the supply of fuel to the carburetor, the pressure and temperature of the fuel and air being supplied to the carburetor, and the operation of the engine, whether it be a cold start, hot start, idling, accelerating, or cruising.

Fuel injection systems allowed computers to take greater control of the engine. Fuel injection systems atomize fuel for introduction into the engine. Computers in the car monitor the engine for a number of factors, but most principally the mass airflow into each cylinder.

With either a carbureted or a fuel-injected engine, the engine produces power in proportion to the amount of fuel supplied to it. Fuel can be carefully consumed, but doing so usually results in less power to the engine. Conversely, consuming fuel at high rates will produce large amounts of power in the engine, but doing so consumes fuel at a greater rate, reducing fuel economy and worsening emissions. Other factors affect power production, such as ambient and engine temperature. High ambient and engine temperatures can reduce the amount of power an engine produces, whether that engine is carbureted or fuel injected. An improved system for improving power production and reduces these effects is needed.

SUMMARY OF THE INVENTION

According to the principle of the invention, a spacer for thermally coupling an intake manifold and a fluid metering device includes a body having an upstream face, an opposed downstream face, and sides extending between the upstream and downstream faces. A bore is formed through the body from the upstream face through to the downstream face. The bore communicates a fuel charge from the carburetor to the intake manifold. Fins are formed in each of the sides, and the fins extend between the bore and the outer periphery. On each side, each fin extends laterally outwardly from a base formed on the body to an edge away from the body, the fins are parallel with respect to the upstream and downstream faces, and each fin is parallel to each other fin. Each fin extends substantially across the side. Grooves defined between the fins are coextensive and extend the same depth into the body.

BRIEF DESCRIPTION OF THE DRAWINGS

Referring to the drawings.

DETAILED DESCRIPTION

Figure 1:
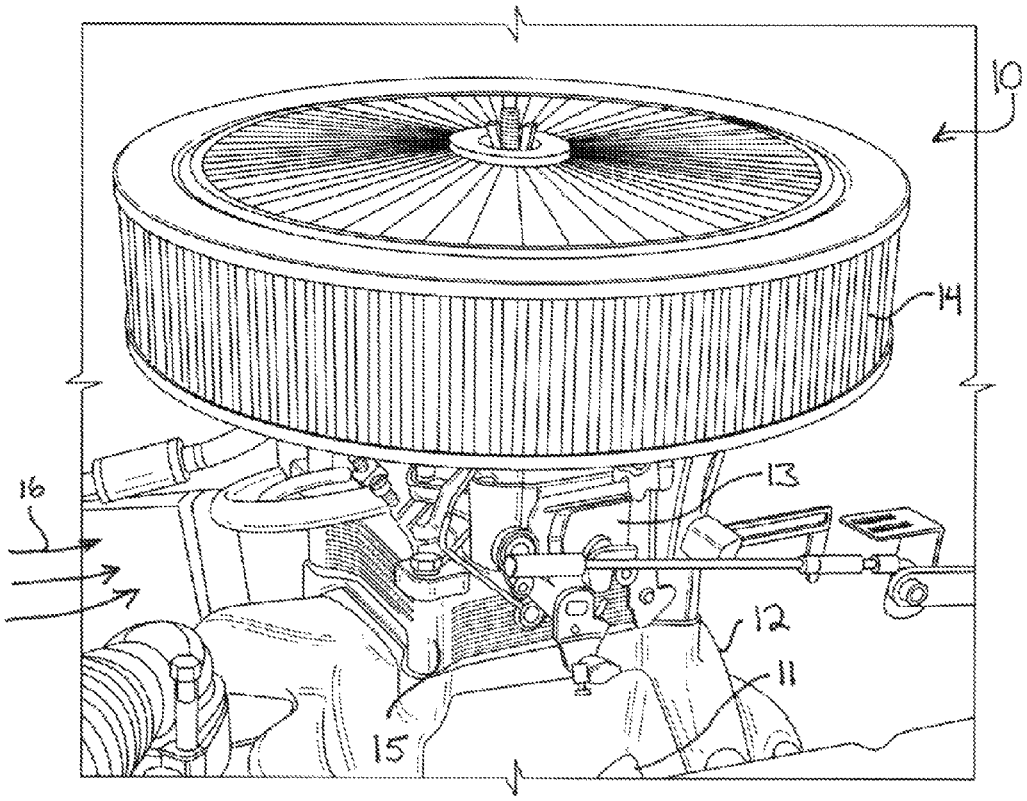
FIG. 1 is a perspective view of an engine compartment of a vehicle showing an internal combustion engine having an intake manifold, a carburetor, an air filter, and a spacer disposed between the intake manifold and the carburetor and constructed and arranged according to the principle of the invention.

Reference now is made to the drawings, in which the same reference characters are used throughout the different figures to designate the same elements. FIG. 1 illustrates an internal combustion engine 10 of an automobile, including an engine block 11 fitted with an intake manifold 12, a carburetor 13, and an air filter 14, as is common in carbureted automobile engines. A finned engine spacer 15 constructed and arranged in accordance with the principle of the invention is mounted between the intake manifold 12 and the carburetor 11 to draw heat from the manifold 12 and release the heat into ambient air. Ambient air is represented by three arrowed lines marked with the reference character 16 throughout the FIGS. The spacer 15 is coupled in good thermal communication with both the intake manifold 12 and the carburetor 13, and is constructed of a material or combination of materials having high coefficients of thermal conductivity, such as billet aluminum, which promote rapid transfer of thermal energy from the manifold 12 through the spacer 15 and into the ambient air 16. While a carburetor is shown in the FIGS. and referred to throughout this description, a carburetor is a fluid metering device for mixing air and fuel, as is a fluid-injection system, and as such, one having ordinary skill in the art will appreciate that the finned engine spacer of the present invention may be coupled between a carburetor and an intake manifold, between a fluid injection system and an intake manifold, and between another fluid metering device and an intake manifold to reduce the transfer of heat to the fluid metering device. The term carburetor is used throughout for simplicity and not to limit the present invention.

Figure 2:
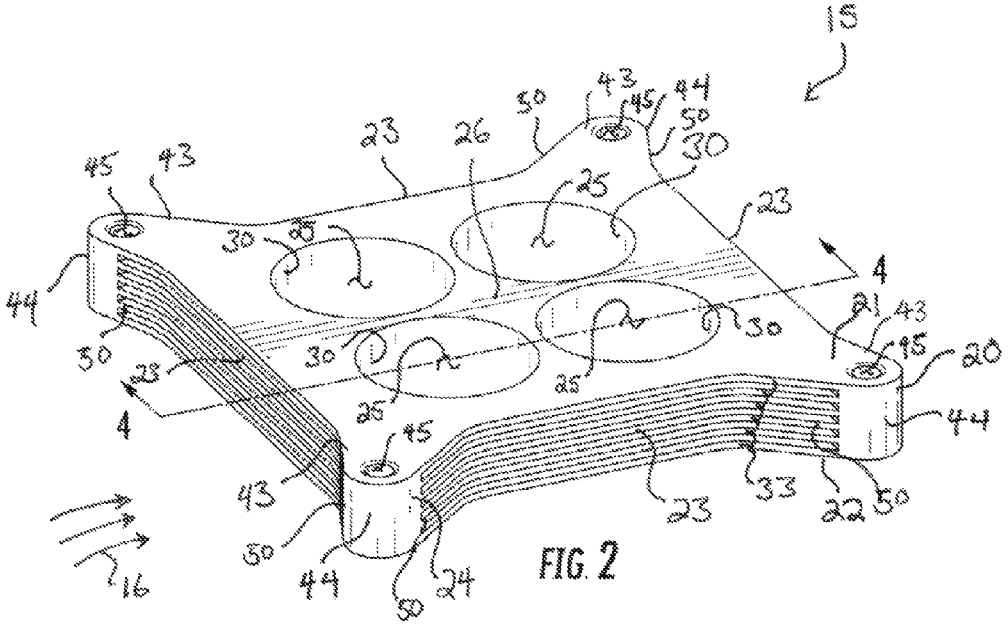
FIG. 2 is a top perspective view of the spacer of FIG. 1.
Figure 3:
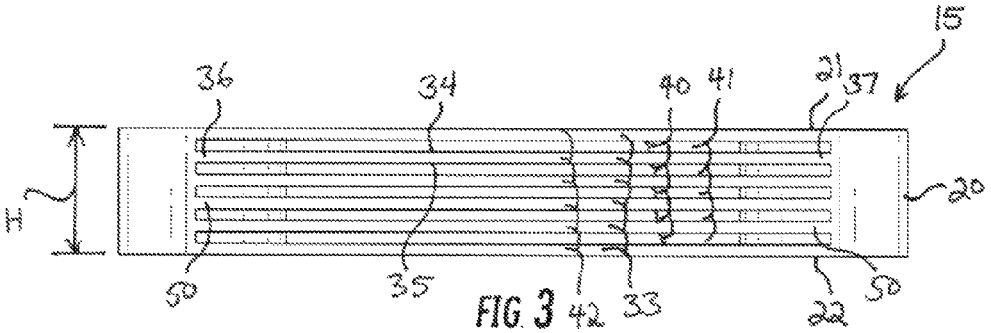
FIG. 3 is a side elevation view of the spacer of FIG. 1.
Figure 4:
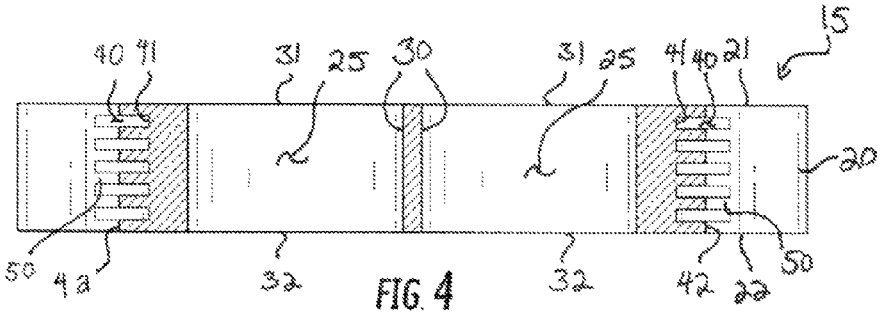
FIG. 4 is a section view of the spacer of FIG. 1 taken along the line 4-4 in FIG. 2.

FIGS. 2-4 illustrate an embodiment of the spacer 15 useful for coupling a four-barrel intake manifold with a four-barrel carburetor. The spacer 15 includes a solid, generally rectangular prismatic body 20 having an upper or upstream face 21, an opposed lower or downstream face 22, and four sides 23 extending between the upstream and downstream faces 21 and 22 defining an outer periphery 24 extending about the body 20. The upstream and downstream faces 21 and 22 are flat, smooth, and parallel with respect to each other. The sides 23 are perpendicular to the upstream and downstream faces 21 and 22, and are generally perpendicular to each other.

Four bores 25 extend through the body 20 of the spacer 15. Each bore 25 is identical in every respect other than location in the body 20, and as such, only one bore 25 will be referred to herein with the understanding that, unless otherwise described, the description applies equally to all four bores 25. The bore 25 extends entirely through the body 20 of the spacer 15 from the upstream face 21 to the downstream face 22. The bore 25 is cylindrical, and has a continuous, cylindrical sidewall 30 bounding the bore 25. The sidewall 30 is perpendicular to the upstream and downstream faces 21 and 22 and parallel to the sides 23. The sidewall 30 terminates at one end at an upper edge 31, defined by the junction of the sidewall 30 and the upstream face 21, and at an opposed end at a lower edge 32, defined by the junction of the sidewall 30 and the downstream face 22. The bore 25 is formed at a generally intermediate location in the body 20, inboard from the sides 23. The four bores 25 are clustered together around a geometric center 26 of the body 20, and are spaced apart from each other.

Each side 23 is formed with a plurality of fins 33. Because each side 23 is identical in every respect, other than location, the fins 33 on one side 23 alone will be described, with the understanding that, unless otherwise described, the description applies equally to the fins 33 on all four sides 23. As shown in FIGS. 2-4, the side 23 includes six fins 33; more or fewer fins 33 could be formed on a side 23. Each fin 33 is an elongate projection from the body 20 and has a top 34, a bottom 35, and opposed ends 36 and 37. Each fin 33 is thin between the top 34 and the bottom 35, and has a very small ratio of height between the top 34 and bottom 35 to length between the ends 36 and 37, such as approximately 1:40. One having skill in the art will readily appreciate that in embodiments in which there are a greater number of thinner fins 33, this ratio will be smaller, and that in embodiments in which there are a fewer number of larger fins 33, this ratio will be larger.

Each fin 33 is formed integrally on an exterior of the body 20 and extends outward from the body 20 on the side 23 from proximate to the bore 25 to the outer periphery 24. Each fin 33 is thus exposed so that the ambient air 16 may flow over each fin 33. The plurality of fins 33 formed on one side 23 are coupled in good thermal conductivity with the body 20 of the spacer 15 and define heat sinks for drawing heat from the body 20.

The fins 33 on the side 23 are tiered on the side 23, or vertically spaced apart by lateral grooves 40 defined between the fins 33. The grooves 40 extend into the body 20 of the spacer from the outer periphery 24 to a base 41. Each groove 40 on the side 23 is coextensive with the other grooves 40 and extends into the body 20 the same depth to the base 41.

Spaced between the grooves 40, the fins 33 extend from the base 41, formed on the body 20, to edges 42 at the outer periphery 24 away from the body 20. The fins 33 extend laterally outwardly from the base 41 to the edge 42, such that each fin 33 is parallel with respect to the upstream and downstream faces 21 and 22. The top 34 and bottom 35 of the fins 33 are parallel to the upstream and downstream faces 21 and 22. Further, the top 34 and bottom 35 of each fin on the side 23 are parallel to the top 34 and bottom 35 of each other fin 33 on the side 23, so that all the fins 33 on the side 23 are parallel to each other. Further still, each fin 33 extends substantially across the side 23.

Adjoining sides 23 form four corners 43, at each of which the body 20 has an extension 44 projecting diagonally outward from the geometric center 26 of the body 20. Each extension 44 is integral to the body 20 and defines a mount formed with a through-hole 45 extending completely through the extension 44 from the upstream face 21 to the downstream face 22. The through-hole 45 is sized to closely fit a bolt for coupling the spacer 15 to the intake manifold 12 and the carburetor 13. The four through-holes 45 cooperate to define a bolt pattern for matching with bolt holes in the intake manifold 12 and the carburetor 13. The extensions 44 project beyond the sides 23 and have flanks 50 which are contiguous to the sides 23. Each flank 50 arcuately curves from the respective side 23 to the extension 44, and the fins 33 extend from the sides 23 through to the flanks 50. On the flanks 50, the fins 33 have reduced depths, such that the edge 42 and the base 41 become closer further along the flank 50 toward the through-hole 45. The fins 33 terminate just inboard of the through-hole 45, where the exterior of the extension 44 is smooth and round. In this way, the fins 33 have a tapered depth which increases along a flank 50 at one end of a side 23, have a constant depth along the side 23, and have a tapered depth which decreases along a flank 50 at the other end of the side 23. Thus, a solid portion of the body 20 encircles the through-hole 45, providing the extension 44 and through-hole 45 with rigidity and strength.

Figure 5:
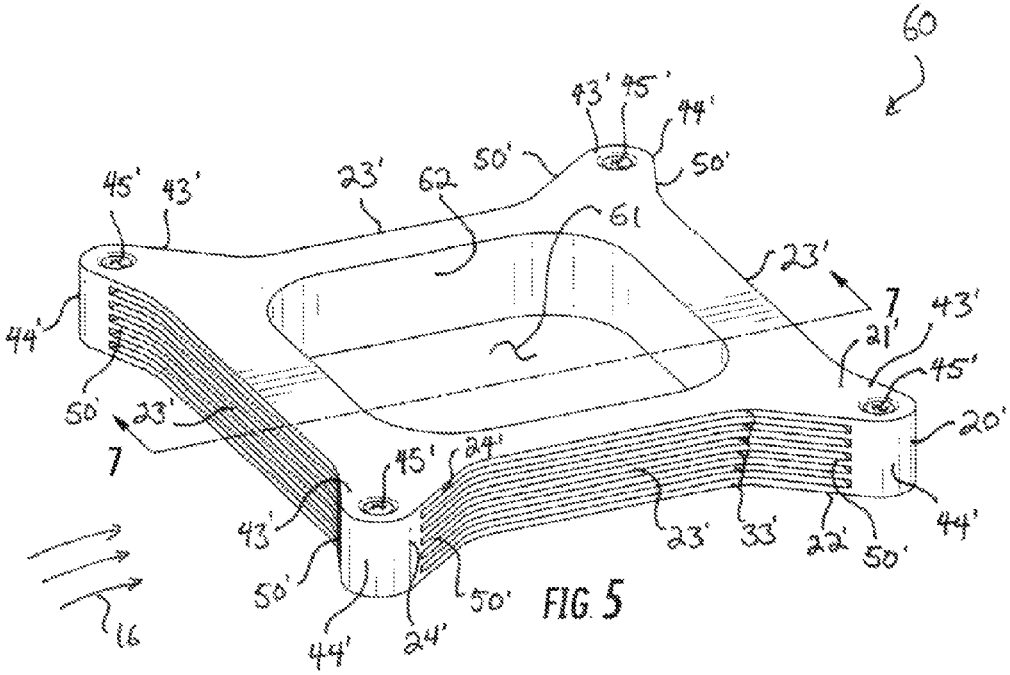
FIG. 5 is a top perspective view of an alternate embodiment of the spacer of FIG. 1.
Figure 6:
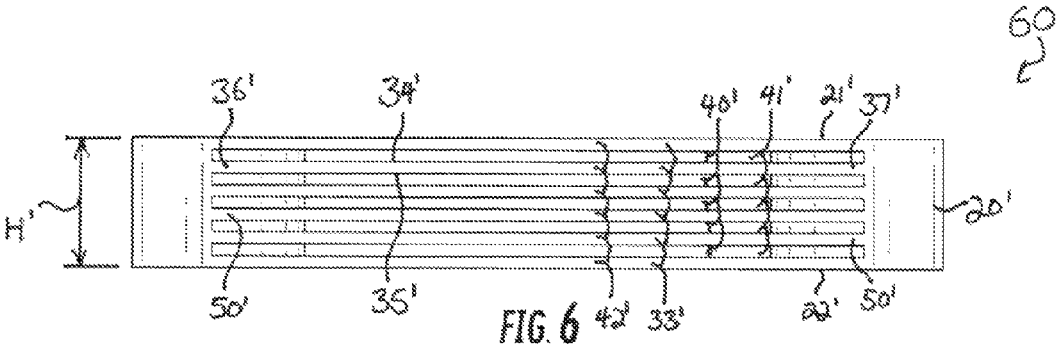
FIG. 6 is a side elevation view of the spacer of FIG. 5.
Figure 7:
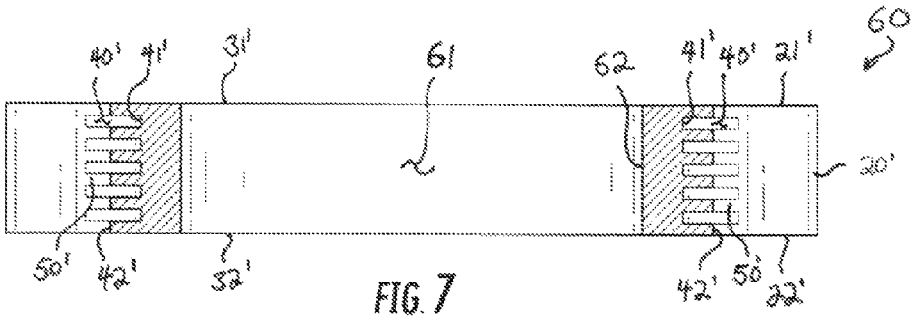
FIG. 7 is a section view of the spacer of FIG. 5 taken along the line 7-7 in FIG. 5.

FIGS. 5-7 illustrate an embodiment of a spacer 60 similar to the spacer 15. The spacer 60 is identical to the spacer 15 in most respects, and throughout FIGS. 5-7, reference characters used to describe the various structural features of the spacer 15 are applied to the spacer 60, but designated with a prime ("') so as to distinguish those structural features from the structural features of the spacer 15. As such, the spacer 60 includes a body 20', an upstream face 21', a downstream face 22', sides 23', a periphery 24', an upper edge 31', a lower edge 32', fins 33', tops 34', bottoms 35', ends 36' and 37', grooves 40', bases 41', edges 42', corners 43', mounts 44', through-holes 45', and flanks 50'.

A single bore 61 extends through the body 20' of the spacer 60. The bore 61 extends entirely through the body 20' of the spacer 60 from the upstream face 21' to the downstream face 22'. The bore 61 is generally rectangular, and has a sidewall 62 bounding the bore 61. The sidewall 62 is perpendicular to the upstream and downstream faces 21' and 22' and parallel to the sides 23'. The sidewall 62 terminates at one end at the upper edge 31', defined by the junction of the sidewall 62 and the upstream face 21', and at another end at the lower edge 32', defined by the junction of the sidewall 62 and the downstream face 22'. The bore 61 is formed at a generally intermediate location in the body 20', inboard from the sides 23'.

Now referring back to FIG. 1 and the spacer 15 shown there, in use, the spacer 15 is mounted between the intake manifold 12 and the carburetor 13 to limit the transfer of thermal energy from the intake manifold 12 to the carburetor 13, as shown in FIG. 1. The upstream face 21 of the spacer 15 is applied entirely against the carburetor 13, forming a seal between the spacer 15 and the carburetor 13, and coupling the four bores 25 in gaseous communication with the carburetor 13, which has four barrels. The downstream face 22 is applied entirely against the intake manifold 12, forming a seal between the spacer 15 and the carburetor 13, and coupling the four bores 25 in gaseous communication with the intake manifold 12, which has four inlet ports coupled in gaseous communication to the cylinders of the engine 10. The carburetor 13 is thus spaced apart from the intake manifold 12 by a distance corresponding to a height H of the spacer 15 between the upstream and downstream faces 21 and 22, as indicated in FIG. 3.

When the engine 10 is operating, the carburetor 13 mixes gasoline with air drawn in from outside the vehicle through the air filter 14. The air, mixed with the gasoline, forms a fuel charge, which is communicated through the carburetor 13 and the spacer 15 to the intake manifold 12, where the fuel charge is distributed to the cylinders of the engine 10. The temperature of the fuel charge affects the volume of the fuel charge, which affects the density of the fuel charge, which affects the power delivered in each unit of fuel charge. If the fuel charge has a relatively high temperature, it will have a relatively low density and a relatively low energy content delivering a correspondingly low amount of power in the engine 10. If the fuel charge has a relatively low temperature, it will have a relatively high density and a relatively high energy content delivering a correspondingly high amount of power in the engine 10.

As the engine 10 operates, it produces heat. That heat radiates to the various parts and structures in the engine compartment which are thermally-conductive and are in contact with the engine 10. Heat is transferred from the intake manifold 12 to the spacer 15 along the entire downstream face 22 of the spacer 15. The body 20 of the spacer 15 absorbs the heat, heating the sidewalls 30 of the bores 25, and transferring the heat throughout the spacer 15. The heat is transferred to the sides 23 of the spacer 15, to the outer periphery 24, and to the fins 33 on the sides 23. The fins 33 are exposed and are disposed into the ambient air 16. The thin, flat fins 33 present to the air 16 a large amount of surface area, relative to the volume of the body 20, along which heat can be drawn off of the fins 33. When the vehicle is not moving, the fins 33 radiate heat into the ambient air 16 inside the engine compartment, which is gradually exchanged with air outside the engine compartment. When the vehicle is moving, the fins 33 radiate heat into the ambient air 16 inside the engine compartment, which is quickly exchanged with air outside the engine compartment; outside air flows into the engine compartment, over the fins, and out the engine compartment, quickly drawing heat off of the fins 33 and away from the spacer 15. As ambient air 16 draws heat off the fins 33, heat is drawn from the body 20, cooling the body 20. Less heat is thus available in the body to be transferred to the carburetor 13, and so less heat is transferred to the carburetor 13, causing the carburetor 13 to become less hot than it would be without the spacer 15. As the fuel moves through the carburetor 13, the fuel is exposed to less heat, and the carburetor 13 produces a fuel charge with a relatively low temperature at a relatively low density and having a correspondingly high energy content.

Table A below presents data gathered in four groups of experiments, demonstrating dissipation of heat from across the spacer 15. Group A shows average temperatures measured across various parts of the four-bore spacer 15 over four tests. Group B shows average temperatures measured across various parts of the four-bore spacer 15 over four later tests. Group C shows average temperatures measured across various parts of the four-bore spacer 15 over two tests. Group C shows average temperatures measured across various parts of the single-bore spacer 60 over six tests. All temperatures are in degrees Fahrenheit.

TABLE A

| | Group A: Four-Bore | Group B: Four-Bore | Group C: Four-Bore | Group D: Single-Bore |
|---|---|---|---|---|
| Average Outside Temperature | 80.5° | 94.6° | 100° | 89.5° |
| Average Engine Temperature | 192.5° | 196.6° | 200° | 193.6° |
| Average Intake Manifold Temperature | 186° | 191° | 197° | 192.5° |
| Average Spacer Temperature | 148° | 160.3° | 171° | 175.8° |
| Average Carburetor Temperature | 131.8° | 144.5° | 156° | 144.6° |

In Group A, the spacer 15 reduced the thermal energy transferred to the carburetor 13 from the engine 10, resulting in a drop of 60.7 degrees Fahrenheit from the engine 10 to the carburetor 13 on a day in which the temperature averaged 94.6 degrees. In Group B, the spacer 15 reduced the thermal energy transferred to the carburetor 13 from the engine 10, resulting in a drop of 52.1 degrees Fahrenheit from the engine 10 to the carburetor 13 on a day in which the temperature averaged 94.6 degrees. In Group C, the spacer 15 reduced the thermal energy transferred to the carburetor 13 from the engine 10, resulting in a drop of 44 degrees Fahrenheit from the engine 10 to the carburetor 13 on a day in which the temperature averaged 94.6 degrees. In Group D, the spacer 60 reduced the thermal energy transferred to the carburetor 13 from the engine 10, resulting in a drop of 49 degrees Fahrenheit from the engine 10 to the carburetor 13 on a day in which the temperature averaged 94.6 degrees.

The fuel charge is communicated from the carburetor 13 through the bores 25 of the spacer 15, which are reduced in temperature. As the fuel charge moves through the bores 25, the fuel charge draws less heat from the sidewalls 30 of the bores 25 because some of the thermal energy sidewalls has been dissipated by the fins 33 into the ambient air 16. The fuel charge is then communicated into the intake manifold and through the ports to the cylinders of the engine 10, providing a more powerful combustion than would be obtained without the spacer 15.

Figure 9:
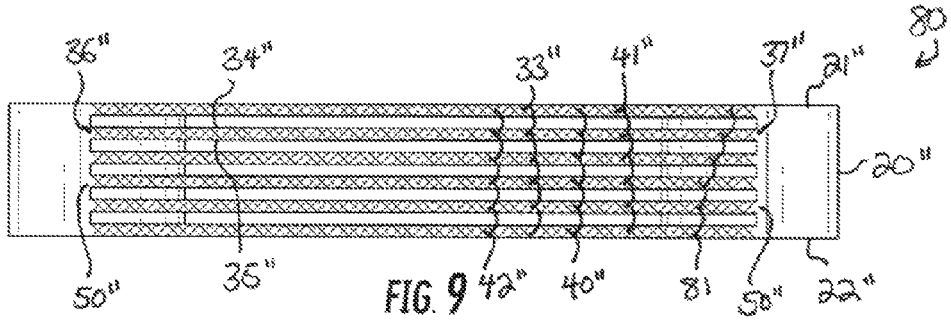
FIG. 9 is a side elevation view of the spacer of FIG. 8.
Figure 10:
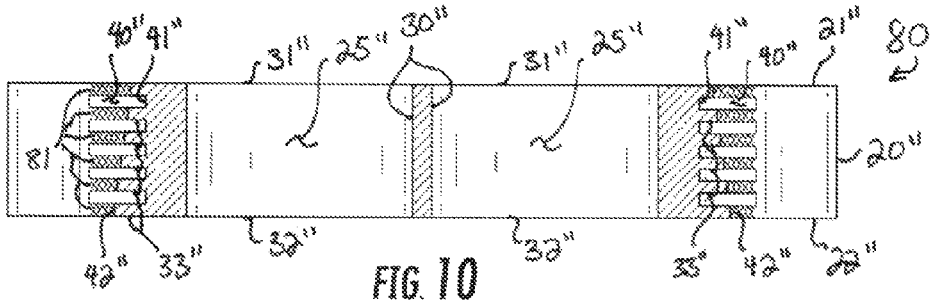
FIG. 10 is a section view of the spacer of FIG. 5 taken along the line 10-10 in FIG. 8.
Figure 11:
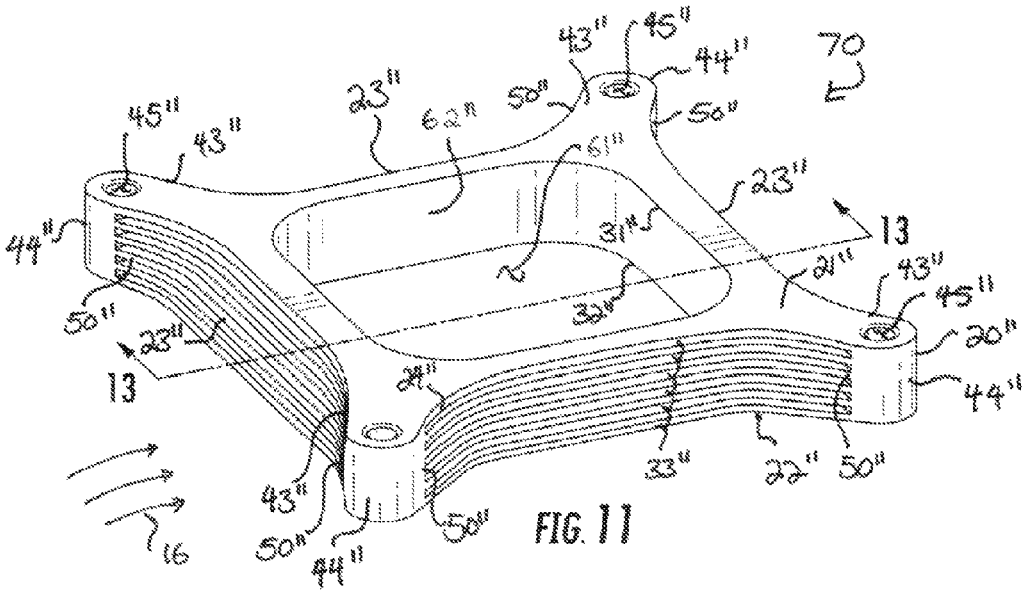
FIG. 11 is a top perspective view of an alternate embodiment of the spacer of FIG. 1.
Figure 12:
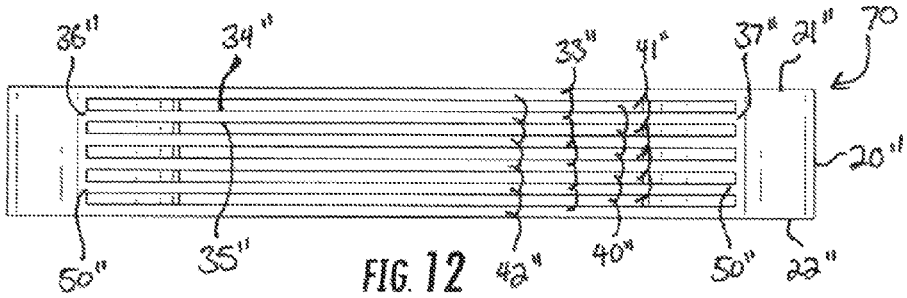
FIG. 12 is a side elevation view of the spacer of FIG. 11.
Figure 13:
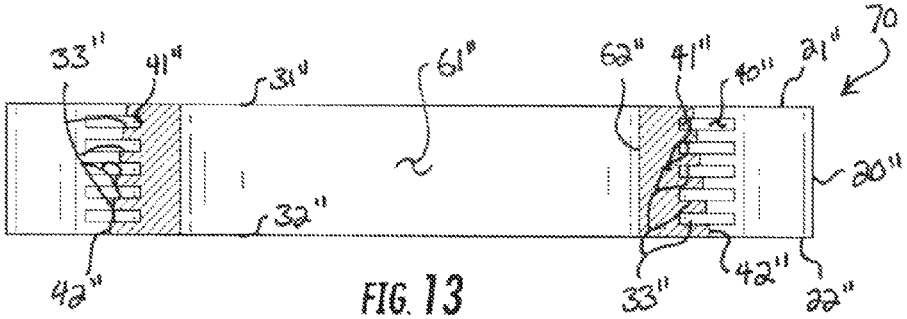
FIG. 13 is a section view of the spacer of FIG. 5 taken along the line 13-13 in FIG. 11.

FIGS. 8-16 illustrate alternate further embodiments of the spacer, constructed and arranged according to the principle of the invention. FIGS. 8-10 and FIGS. 11-13 show two similar embodiments. Turning to FIGS. 11-13 first, a spacer 70 is shown. The spacer 70 is identical to the spacer 60 in most respects, and throughout FIGS. 11-13, reference characters used to describe the various structural features of the spacer 60 are applied to the spacer 70, but designated with a double prime (“”) so as to distinguish those structural features from the structural features of the spacer 60. As such, the spacer 70 includes a body 20", an upstream face 21", a downstream face 22", sides 23", a periphery 24", an upper edge 31", a lower edge 32", fins 33", tops 34", bottoms 35", ends 36" and 37", grooves 40", bases 41", edges 42", corners 43", mounts 44", through-holes 45", and flanks 50", single bore 61", and sidewall 62". One having reasonable skill in the art will readily appreciate that although the spacer 70 is shown as having a single bore 61", the spacer 70 could have multiple bores as described herein with respect to other embodiments.

The fins 33' of the spacer 70 are different from the fins 33' of the spacer 60. On the spacer 70, the fins 33" are stepped from the downstream face 22 to the upstream face 21. In this stepped arrangement, the fin 33" proximate to the downstream face 22" is longer (from the base 41" to the edge 42") than the fin 33" just above, which is longer than the fin 33" just above, and so on, with the fin 33' proximate to the upstream face 21" being the shortest fin 33". This is shown most clearly in FIG. 13, the section view of the spacer 70, in which the bottom-most fin 33" is longer than all fins 33" above it, the next bottom-most fin 33" is longer than all fins 33" above it, and so on, with the top-most fin 33' being the shortest. The edge 42" of each fin 33" is disposed inboard and set back from the edge 42" of the fin 33" below it. In this way, heat radiating upwards off each fin 33", especially when the vehicle is not moving forward, radiates into the ambient air 16, rather than radiating into the bottom 35" of the fin 33" above.

Figure 8:
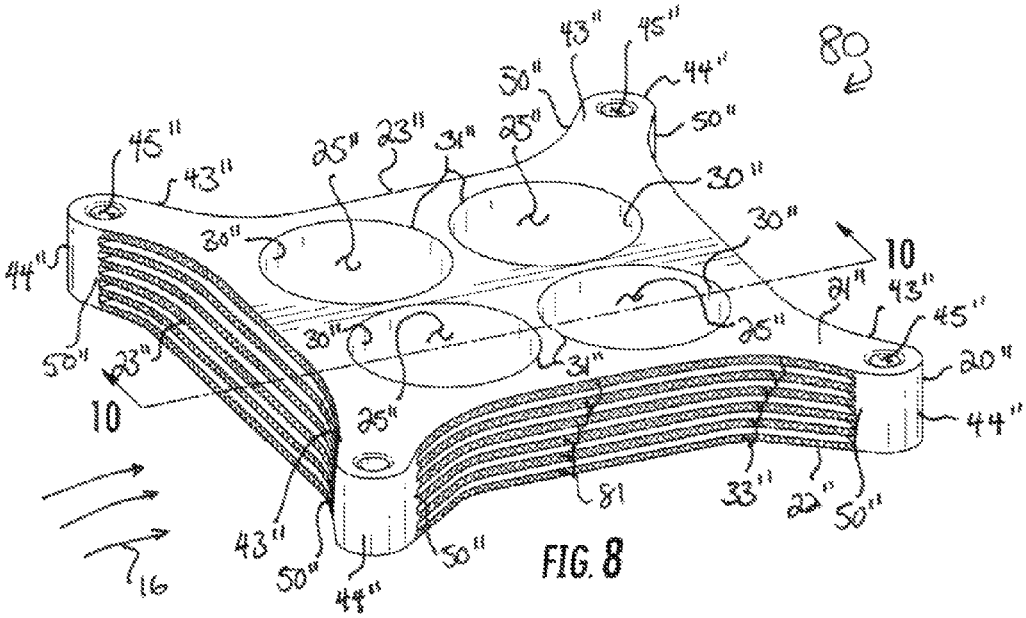
FIG. 8 is a top perspective view of an alternate embodiment of the spacer of FIG. 1.

Turning now to FIGS. 8-10, shown there is a spacer 80 nearly identical in to the spacer 70. Spacer 80 has every structural feature and element that spacer 70 does, except that spacer 80 has four bores 25" (rather than one bore) and has one additional feature formed on the edges 42" of the fins 33". As such, the reference characters of spacer 70 are applied to the spacer 80 without modification to the double prime ("""). The spacer 80 includes a body 20", an upstream face 21", a downstream face 22", sides 23", a periphery 24", an upper edge 31", a lower edge 32", fins 33", tops 34", bottoms 35", ends 36" and 37", grooves 40", bases 41", edges 42", corners 43", mounts 44", through-holes 45", and flanks 50", the four bores 25", four sidewalls 30". One having reasonable skill in the art will readily appreciate that although the spacer 80 is shown as having four bores 25", the spacer 80 could have a single bore as described herein with respect to other embodiments. The fins 33" of the spacer 80 are stepped. Additionally, the edges 42" of the fins 33" are formed with notching or scoring 81 arranged in a cross or diamond-cut pattern across each fin 33" between the ends 36" and 37". On each fin 33", the scoring 81 extends just slightly into the fin 33" and is arranged in alternating and intersecting diagonal orientations between top 34" and bottom 35" of the fin 33". The scoring 81 provides the edge 42" of each fin 33" with additional surface area at which heat can be radiated off of the fin 33".

Figures 14, 15, 16:
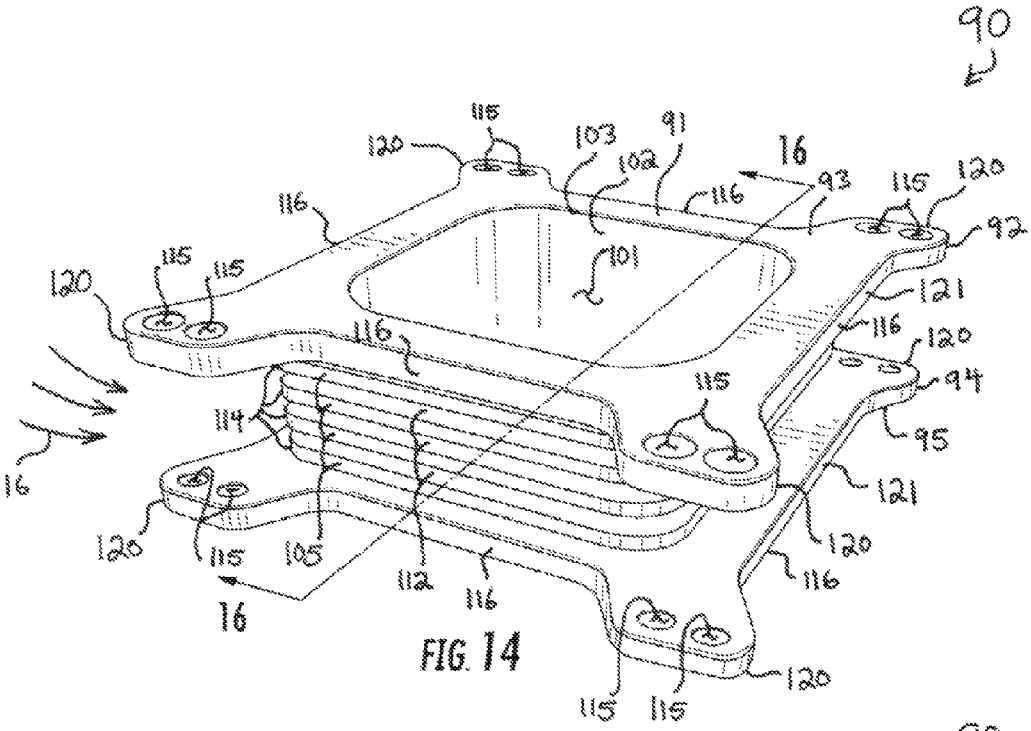
FIG. 14 is a top perspective view of an alternate embodiment of the spacer of FIG. 1.
FIG. 15 is a side elevation view of the spacer of FIG. 14.
FIG. 16 is a section view of the spacer of FIG. 5 taken along the line 16-16 in FIG. 14.

Turning now to FIGS. 14-16, illustrated here is another alternate embodiment of a finned engine spacer, identified with the reference character 90. The spacer 90 is similar in structure and function to the spacer 15. The spacer 90 has a solid body 91 having an upper plate 92 with an upstream face 93 and a lower plate 94 with a downstream face 95. The upper and lower plates 92 and 94 are thin and parallel with respect to each other, and the upstream and downstream faces 93 and 95 are flat, smooth, and parallel with respect to each other. A single, generally rectangular bore 101 extends through the body 91 of the spacer 90. The bore 101 extends entirely through the body 91 of the spacer 90 from the upstream face 93 to the downstream face 95. The bore 101 has a sidewall 102 bounding the bore 101 and extending between the upper and lower plates 92 and 94. The sidewall 102 is perpendicular to the upper and lower plates 92 and 94. The sidewall 102 terminates at one end at an upper edge 103, defined by the junction of the sidewall 102 and the upstream face 93, and at an opposed end at a lower edge 104, defined by the junction of the sidewall 102 and the downstream face 95. The bore 101 is formed at a generally intermediate location inboard in the body 91.

The sidewall 102 is formed with a plurality of fins 105. As shown in FIGS. 14-16, the spacer 90 has five fins 105; more or fewer fins 105 could be formed on the sidewall 102. Each fin 105 is an elongate projection from the sidewall 102 and has a top 110 and an opposed bottom 11, and extends continuously around the sidewall 102. Each fins 105 is thin between the top 110 and bottom 111. One having ordinary skill in the art will readily appreciate that in embodiments in which there are a greater number of fins 105, each fin 105 will be thinner, and that in embodiments in which there are fewer fins 105, each fin 105 may be thicker.

Each fin 105 is formed integrally to an exterior of the sidewall 102 and extends outwardly from the sidewall 105. Each fin 105 is thus exposed so that the ambient air 16 may flow over each fin 105. The integral formation to the sidewall 102 couples the plurality of fins 105 in good thermal conductivity with the body 91 of the spacer 90 and defines the fins 105 as heat sinks for drawing heat from the body 90. The fins 105 are tiered, or vertically spaced apart by lateral grooves 112 defined between the fins 105. The grooves 112 extend continuously around the spacer 90 and into the body 91 of the spacer 90 to a base 113 located at the sidewall 102. Each groove 112 is coextensive with each other groove 112 and extends the same depth into the body 91.

Spaced between the grooves 112, the fins 105 extend from the bases 113, formed on the sidewall 102 of the body 91, to edges 114 away from the sidewall 102. Each fin 105 extends laterally outwardly from the base 113 to the edge 114, such that each fin 105 is parallel with respect to the upstream and downstream faces 93 and 95. The top and bottom 110 and 111 of each fin 105 are parallel to the upstream and downstream faces 93 and 95. Further, the top 110 and bottom 111 of each fin 105 are parallel to the top 110 and bottom 111 of each other fin 105, so that all the fins 105 are parallel to each other.

The upper and lower plates 92 and 94 are each formed with two through-holes 115 at the corners 120, which are extensions formed at the corners of both of the upper and lower plates 92 and 94 and projecting diagonally outward from the body 91. The through-holes 115 of the upper plate 92, at a corner 120, are aligned with the through-holes 115 of the lower plate 94, at a respective corner, so as to be available to receive bolts passed completely through the spacer 90 to couple the spacer between the intake manifold 12 and the carburetor 13. In this way, the corners 120, and the through-holes 115 formed through the corners 120, are mounts for coupling the spacer 90 to the intake manifold 12 and the carburetor 13. The through-holes are sized to closely fit the bolts. The sixteen through-holes 115 cooperate to define a bolt pattern for matching with bolt holes in the intake manifold 12 and the carburetor 13.

The upper and lower plates 92 and 94 each have four identical sides 116, which cooperate to form curved peripheries 121 on both of the upper and lower plates 92 and 94 extending about the upper and lower plates 92 and 94. Both of the peripheries 121 flare laterally outward at the corners 120 to define projections through which the through-holes 115 are formed. The peripheries 121 define the lateral outer limit of the spacer 90. The fins 105 are recessed within that outer limit; the edges 114 of the fins 105 are disposed inboard with respect to the peripheries 121, at a location generally intermediate between the peripheries 121 and the sidewall 102.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

1. A spacer for coupling between an intake manifold and a fluid metering device, the spacer comprising:

a body including an upstream face, an opposed downstream face, and sides extending between the upstream and downstream faces, the sides cooperating to form an outer periphery of the body;

a bore having a smooth sidewall formed through the body from the upstream face through to the downstream face, the bore for communicating a fuel charge from the fluid metering device to the intake manifold;

fins formed in each of the sides, the fins extending between the bore and the outer periphery and into ambient air.

2. The spacer of claim 1, wherein on each side, each fin extends laterally outwardly from a base formed on the body to an edge away from the body.

3. The spacer of claim 1, wherein on each side, the fins are parallel with respect to the upstream and downstream faces.

4. The spacer of claim 1, wherein on each side, each fin is parallel to each other fin.

5. The spacer of claim 1, wherein on each side, the fins are vertically spaced apart on the side.

6. The spacer of claim 1, wherein the fins are stepped from the downstream face to the upstream face.

7. The spacer of claim 1, wherein the fins have scored edges.

8. The spacer of claim 1, wherein the fins have edges which are disposed inboard from the outer periphery of the body.

9. A spacer coupled in thermal communication between an intake manifold and a fluid metering device, the spacer comprising:

a solid body to draw thermal energy from the intake manifold;

a bore having a smooth sidewall formed through the body, the bore coupled in gaseous communication between the intake manifold and the fluid metering device to communicate a fuel charge from the fluid metering device to the intake manifold;

a heat sink formed on the body and disposed in the ambient air so as to dissipate heat from the intake manifold into the ambient air.

10. The spacer of claim 9, wherein the heat sink is disposed on an exterior of the body between the intake manifold and the fluid metering device.

11. The spacer of claim 9, wherein:

the body has an upstream face, an opposed downstream face, and sides extending between the upstream and downstream faces; and the heat sink is formed on the sides of the body.

12. The spacer of claim 11, wherein:

the downstream face is applied entirely against the intake manifold; and the upstream face is applied entirely against the fluid metering device.

13. The spacer of claim 9, wherein the heat sink includes fins.

14. The spacer of claim 13, wherein each fin extends laterally outwardly from a base formed on the body to an edge away from the body.

15. The spacer of claim 13, wherein the fins are stepped from a downstream face of the body to an upstream face of the body.

16. The spacer of claim 13, wherein the fins have scored edges.

17. A spacer limiting the transfer of thermal energy from an intake manifold to a fluid metering device, the spacer mounted between the intake manifold and fluid metering device, and comprising:

a solid body including an upstream face, an opposed downstream face, and sides extending between the upstream and downstream faces, the sides cooperating to form an outer periphery of the body;

a bore having a smooth sidewall formed integrally through the body from the upstream face through to the downstream face, the bore for communicating a fuel charge from the fluid metering device to the intake manifold;

exposed fins formed in each of the sides, the fins extending between the bore and the outer periphery.

18. The spacer of claim 17, wherein:

the downstream face is applied entirely against the intake manifold; and the upstream face is applied entirely against the fluid metering device.

19. The spacer of claim 17, wherein on each side, each fin extends laterally outwardly from a base formed on the body to an edge away from the body.

20. The spacer of claim 17, wherein on each side, the fins are parallel with respect to the upstream and downstream faces and the fins are vertically spaced apart on the side.

21. The spacer of claim 17, wherein on each side, each fin is parallel to each other fin.

22. The spacer of claim 17, wherein the fins are stepped from the downstream face to the upstream face.

23. The spacer of claim 17, wherein the fins have scored edges.

24. The spacer of claim 17, wherein the fins have edges which are disposed inboard from the outer periphery of the body.

* * * * *